US008042809B2

(12) United States Patent
Walker et al.

(10) Patent No.: US 8,042,809 B2
(45) Date of Patent: Oct. 25, 2011

(54) LOTTERY GAME CARD AND METHOD FOR CONDUCTING A LOTTERY GAME

(75) Inventors: Jay S. Walker, Ridgefield, CT (US); Stephen C. Tulley, Stamford, CT (US); Daniel E. Tedesco, Westport, CT (US); James A. Jorasch, Stamford, CT (US)

(73) Assignee: Walker Digital, LLC, Stamford, CT (US)

( * ) Notice: Subject to any disclaimer, the term of this patent is extended or adjusted under 35 U.S.C. 154(b) by 0 days.

(21) Appl. No.: 12/612,460

(22) Filed: Nov. 4, 2009

(65) Prior Publication Data

US 2010/0048278 A1 Feb. 25, 2010

Related U.S. Application Data

(63) Continuation of application No. 10/649,180, filed on Aug. 27, 2003, now abandoned, which is a continuation of application No. 09/596,008, filed on Jun. 16, 2000, now Pat. No. 6,676,126.

(51) Int. Cl.
*A63F 3/06* (2006.01)

(52) U.S. Cl. ..... 273/139; 283/903

(58) Field of Classification Search ..... 273/139, 273/903; 463/16–20

See application file for complete search history.

(56) References Cited

U.S. PATENT DOCUMENTS 816,553 A 4/1906 Becker
1,888,980 A 11/1932 Dingledine
2,474,573 A * 6/1949 Cohen ..... 273/269
3,811,679 A 5/1974 Benge
3,918,174 A 11/1975 Miller et al. ..... 35/9 R
4,323,770 A * 4/1982 Dieulot et al. ..... 463/25
4,429,877 A 2/1984 Coppock ..... 273/139
4,466,614 A 8/1984 Bachman et al. ..... 273/139
4,756,531 A * 7/1988 DiRe et al. ..... 463/18
4,756,532 A 7/1988 Kamille ..... 273/153 R
4,964,642 A 10/1990 Kamille ..... 273/240
5,092,598 A * 3/1992 Kamille ..... 273/139
5,094,458 A 3/1992 Kamille ..... 273/240
5,118,109 A 6/1992 Gumina ..... 273/139
5,193,815 A 3/1993 Pollard ..... 273/269
5,290,033 A 3/1994 Bittner et al. ..... 273/138 A
5,407,199 A * 4/1995 Gumina ..... 273/139
(Continued)

OTHER PUBLICATIONS

"Kentucky Lottery to test new 'Probability' games.", Kentucky Lottery Corporation, (http //www apex net/users/sdsimon/news/article%203 html), Copyright 1998.

(Continued)

*Primary Examiner* — William Pierce
(74) *Attorney, Agent, or Firm* — Fincham Downs LLC; Michael D. Downs

(57) ABSTRACT

A lottery game incorporates player direction in determining the outcome of the game and allows a player to reveal one or more elements in a lottery game area according to rules associated with the lottery game. According to one embodiment of the invention, the player may expose initially any element of the lottery game area, and every exposable element includes an indication of at least two other exposable adjacent elements that may next be selected. The player's progression through the lottery game is not predetermined such that the player has significant ability or flexibility to control or direct the play of the lottery game and to influence or direct the outcome of the lottery game (e.g., embodied by the card).

12 Claims, 8 Drawing Sheets

U.S. PATENT DOCUMENTS

| | | | | |
|---|---|---|---|---|
| 5,407,205 | A | 4/1995 | Larson | |
| 5,411,260 | A * | 5/1995 | Smith | 273/139 |
| 5,417,424 | A | 5/1995 | Snowden et al. | 273/138 A |
| 5,451,052 | A | 9/1995 | Behm et al. | 273/139 |
| 5,474,294 | A * | 12/1995 | Sandeen | 463/20 |
| 5,690,367 | A | 11/1997 | Fromer | 283/94 |
| 5,709,603 | A | 1/1998 | Kaye | 463/17 |
| 5,791,990 | A | 8/1998 | Schroeder et al. | 463/17 |
| 5,797,794 | A * | 8/1998 | Angell | 463/18 |
| 5,818,019 | A | 10/1998 | Irwin, Jr. et al. | 235/375 |
| 5,855,514 | A | 1/1999 | Kamille | 463/17 |
| 5,871,398 | A | 2/1999 | Schneier et al. | 463/16 |
| 5,931,467 | A * | 8/1999 | Kamille | 273/139 |
| 5,938,200 | A | 8/1999 | Markowicz et al. | 273/246 |
| 5,944,354 | A | 8/1999 | Feola | 283/67 |
| 6,099,408 | A * | 8/2000 | Schneier et al. | 463/29 |
| 6,102,798 | A | 8/2000 | Bennett | 463/16 |
| 6,264,557 | B1 * | 7/2001 | Schneier et al. | 463/29 |
| 6,273,817 | B1 | 8/2001 | Sultan | |
| 6,435,500 | B2 * | 8/2002 | Gumina | 273/139 |
| 6,450,885 | B2 * | 9/2002 | Schneier et al. | 463/29 |
| 6,669,560 | B2 * | 12/2003 | Eklund et al. | 463/17 |
| 6,761,633 | B2 | 7/2004 | Riendeau et al. | |
| 7,431,645 | B2 * | 10/2008 | Han et al. | 463/16 |
| 7,654,529 | B2 * | 2/2010 | Rogers | 273/139 |

OTHER PUBLICATIONS

"Inter@ctive Media—Web Promos Start From Scratch", (http //www realtimemedia com/press/interactive html), Feb. 1999.

"Scientific Games Products & Services", (http //www scigames com/sciscan htm), download date: Mar. 10, 1999.

"The 6th Annual In-Store Challenge, Catalina Marketing Corporation", Adams Business Media, Inc., (http //www fbmonline com/0399/399cat asp), download date: May 14, 1999.

"Battle Cards", Geocities Timessquare, (http //www geocities com/TimesSquare/Cavern/7378/battleca html), download date: May 14, 1999.

"World Lottery Association (AILE '98) Congress Report", Lottery Insider, (http www lotteryinsider com au/aile/report htm), download date: May 14, 1999.

"Newsletter vol. 4 No. 6", Lottery Insider, (http //www lotteryinsider com/au/vol4/no6 html), download date: May 14, 1999.

"Newsletter vol. 3 No. 6", Lottery Insider, (http //www lotterinsider com au/vol3/no6 html), download date: May 14, 1999.

"Maine State Lottery", (http //www mainelottery com/race html), download date: May 14, 1999.

"Maine Instant Scratch Games", (http //www mainelottery com/scratch html), download date: May 14, 1999.

"National Lottery News Highlights, From the May 12th issue", (http //www lotterynews com/news/news html), download date: May 14, 1999.

Popp, Mark J. (Compiled and maintained by), "Other Fighting Fantasy Merchandise", (http //www cadvision com poppmj ffother htm), download date: May 14, 1999.

"Premium Games, Enhanced Appeal, Interactive, Multi-Media, Excitement, Exchange", (http //www uwin net/Literature/premiumGames html), download date: May 14, 1999.

"Lottery Vendors, Scientific Games, News", Scientific Games International, (http //www lotteryinsider com au/vendors/scigames htm), download date: May 14, 1999.

"Today's Winning Numbers", Kentucky Lottery Main Index Page, (http //www kylottery com/start3 html), download date: May 14, 1999.

"U Win!, A GTECH Company", (http //www uwin net/), download date: May 14, 1999.

"Every Blackjack Ticket can Be a Winner!", Kentucky Lottery, (http //www kylottery com/probability/play_bj htm), download date: Jun. 13, 2000.

Office Action for U.S. Appl. No. 09/596,008 dated Dec. 3, 2001, 5 pp.

Office Action for U.S. Appl. No. 09/596,008 dated Jun. 19, 2002, 6 pp.

Office Action for U.S. Appl. No. 09/596,008 dated Nov. 13, 2002, 4 pp.

Notice of Allowability for U.S. Appl. No. 09/596,008 dated May 27, 2003, 1 pg.

Office Action for U.S. Appl. No. 10/649,180 dated Aug. 8, 2008, 7 pp.

Office Action for U.S. Appl. No. 10/649,180 dated Feb. 7, 2008, 6 pp.

Office Action for U.S. Appl. No. 10/649,180 dated Mar. 28, 2006, 5 pp.

Office Action for U.S. Appl. No. 10/649,180 dated Sep. 29, 2005, 5 pp.

* cited by examiner

LOTTERY GAME CARD AND METHOD FOR CONDUCTING A LOTTERY GAME

This application is a continuation of U.S. patent application Ser. No. 10/649,180 filed Aug. 27, 2003 and now abandoned and entitled LOTTERY GAME CARD AND METHOD FOR CONDUCTING A LOTTERY GAME, which is a continuation of U.S. patent application Ser. No. 09/596,008, filed Jun. 16, 2000 and issued as U.S. Pat. No. 6,676,126 on Jan. 13, 2004 and entitled LOTTERY GAME CARD AND METHOD FOR CONDUCTING A LOTTERY GAME.

Each of the above-referenced applications is incorporated by reference herein in its entirety.

BACKGROUND OF THE INVENTION

1. Field of the Invention

The present invention relates generally to a lottery game and, more particularly, to a method and apparatus for playing a lottery game that incorporates player direction in determining the outcome of the game.

2. Description of the Prior Art

There are many different types of lottery games and many different forms of state-run and nationally-run lotteries that are conducted. Within a traditional lottery, in exchange for a comparatively small wager, typically one dollar, a customer can select lottery numbers and purchase a lottery ticket having a chance to win a jackpot or other prize. Although the number of lottery tickets sold to customers may ultimately determine an amount of a jackpot, players currently only have limited ways in which to directly influence a game's outcome or their likelihood of winning during any one particular contest. Additionally, organizations offering traditional lottery games typically execute drawings once or twice per week. This infrequency of opportunity can sometimes lead to a lapse in lottery ticket sales, particularly during extended times when jackpots fail to exceed certain thresholds, and consequently do not motivate sales among people who typically would not play.

Another type of lottery game is the instant ticket or "scratch-off" game by which players may receive payouts immediately. This style of lottery game typically involves a purchase of a paper or cardboard game card. In most cases, a player, to reveal combinations of symbols or values, actively uncovers or exposes a portion, selection, or element of the game card concealed by a latex covering or other removable concealer. Certain combinations of symbols or values correspond to prizes, which may be paid out to a player at any participating lottery merchant. Although such game cards offer increased accessibility to games of chance, players currently have only limited means for actively affecting the eventual outcome associated with any particular card. In many instances, players feel that the outcomes associated with scratch-off games are "fixed" or purposely designed to result in an unfavorable outcome, and therefore, that pure luck makes the only difference between winning and losing. As a result, would-be players often abstain from participation in such lottery games. In addition, many players view the act of playing such lottery games as a passive and boring experience. In fact, the vast majority of scratch-off games currently at market require only that a player reveal one generally designated play area of the ticket. Simply purchasing a card, and revealing a predetermined outcome does not appeal to every potential player. Thus, despite the state-of-the-art in lottery games, there remains a need to provide a scratch-off type lottery game and ticket that allows a player to direct the outcome of the lottery game and that incorporates player direction and selection into the outcome of the lottery game.

SUMMARY OF THE INVENTION

Accordingly, it is an object of the present invention to provide a method and apparatus for conducting a lottery game and to provide a method and apparatus for playing a lottery game that incorporates player direction in determining the outcome of the game. Such a lottery game may be embodied, for example, as a scratch-off type lottery card, wherein a player may expose one or more elements on the card according to rules of the lottery game. In some embodiments, all of the possible combinations of playable elements on a card may be known or knowable to the player in advance or before the player begins to expose elements on the card. In other embodiments, a set of possible elements that the player may expose are known to the player before the player begins to expose elements on the card. In general, a player's progression through a card is not predetermined, thereby providing the player an ability or flexibility to control or direct the play of the lottery game embodied by or on a card and to influence or direct the outcome of the lottery game embodied by the card.

Additional objects, advantages, and novel features of the invention shall be set forth in part in the description that follows, and in part will become apparent to those skilled in the art upon examination of the following or may be learned by the practice of the invention. The objects and the advantages may be realized and attained by means of the instrumentalities and in combinations particularly pointed out in the appended claims.

To achieve the foregoing and other objects and in accordance with the purposes of the present invention, as embodied and broadly described herein, a printed or electronic lottery game card includes multiple exposable elements, a first rule associated with the card indicating how at least one element on the card can be exposed, and a second rule associated with the card indicating how the card can be deemed a winning card, wherein multiple sets of exposures of elements on the card will satisfy the first rule and at least one of the sets of exposures of the elements on the card will satisfy the second rule, further wherein any of the multiple exposable elements on the card can be exposed first on the card without violating the first rule. In some embodiments of the lottery game card, each set of exposures of elements on the card that satisfy the first rule are determinable by a player prior to any exposure of any element on the card by the player. In other embodiments of the lottery game card, the card includes multiple elements, wherein each of the multiple elements on the card is linked to at least one other element on the card such that after a player exposes a first element on the card, said player may also expose a second element on the card that is linked to the first element, further wherein any exposable element on the card can be exposed first on the card by the player.

To further achieve the foregoing and other objects and in accordance with the purposes of the present invention, as embodied and broadly described herein, a method for conducting a lottery game includes (a) providing a signal indicative of a card including multiple exposable elements, wherein each of the multiple exposable elements on the card is linked to at least one other element on the card such that after a player exposes a first element on the card, the player may also expose a second element on said card that is linked to the first element, further wherein any exposable element on the card can be exposed first on the card by the player; (b) receiving a signal indicative of a selection of an element on the card; (c)

providing a signal indicative of the card with the selected element exposed on the card; and (d) repeating the steps (b) and (c) until a game outcome is reached for the card.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention. In the Drawings.

DETAILED DESCRIPTION OF THE EMBODIMENTS

A method and apparatus are provided for conducting a lottery game that incorporates player direction in playing the lottery game and in determining the outcome of the lottery game. The lottery game may be embodied by a printed card, such as a scratch-off type card, or by an electronic signal representative or indicative of a lottery card. In some embodiments, all of the possible combinations of playable elements of a card may be known or knowable to the player in advance or before the player begins to expose elements on the card. In other embodiments, a set of possible elements on a card from which the player may expose one or more elements is known to the player before the player begins to expose elements on the card. In general, a player's progression through a card is not predetermined, thereby providing the player an ability or flexibility to control or direct the play of the lottery game card and thus to influence or direct the outcome of the lottery game embodied by or on the card.

Figure 1:
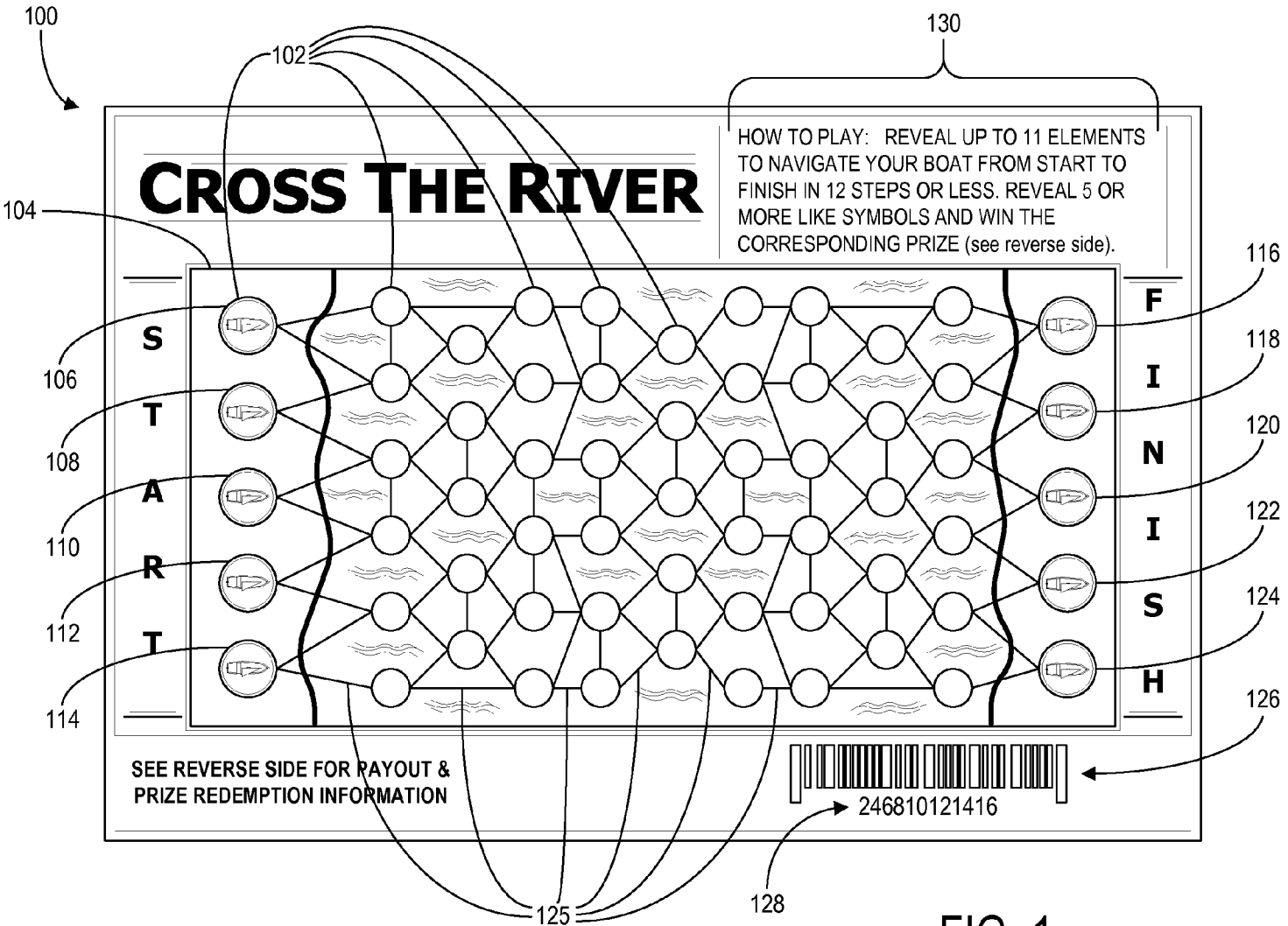
FIG. 1 is an elevation view of a first embodiment of a lottery or scratch-off game card in accordance with the present invention.

A first embodiment of a lottery ticket or card 100 configured in accordance with the present invention is illustrated in FIG. 1. The card 100 is configured as a scratch-off type game ticket for a lottery game entitled "CROSS THE RIVER" wherein a player reveals, exposes, uncovers, etc. one or more of the play elements, selections or pads 102, up to a maximum of eleven elements or pads, such that a connected, continuous or linked path is formed in the play area 104 between and including one of the start elements 106, 108, 110, 112, 114 and one of the finish elements 116, 118, 120, 122, 124. Thus, a continuous or linked path will be formed from one of the start elements 106, 108, 110, 112, 114 to one of the finish elements 116, 118, 120, 122, 124, thereby allowing the player to "cross the river." Each of the elements on the card 100, including each of the start elements 106, 108, 110, 112, 114 and each of the finish elements 116, 118, 120, 122, 124, are linked to at least one other element on the card 100 via a link 125 as a result of the graphic design of the card 100. The ticket or card 100 also includes a bar code 126 and a numerical designator 128 which may identify the ticket 100 or provide coded information associated with the ticket 100.

As shown by instructions or rules 130 for the card 100, a player "crossing the river" in twelve steps or less and revealing five or more like symbols may win a prize associated with the five or more like symbols. Thus, some or all of the game elements 102 preferably include at least one symbol, bar code, identifier, etc. that is uncovered or revealed when a player selects or otherwise plays the elements. More specifically, in order for lottery retailers or operators to accurately distinguish winning cards from non-winning cards, a series of symbols, bar codes, identifiers, etc. may be placed on the card 100 at certain junctures formed by the elements 102. The symbols, bar codes, identifiers, etc. preferably are exposed and/or removed by a player selecting a route through the card 100 when playing the "CROSS THE RIVER" game. The symbols, bar codes, identifiers, etc. may be initially concealed on the card 100 by a covering or removable concealer, such as latex, and correspond all or in part to a unique computer-readable ticket identifier printed on the card 100, such as by the bar code 126 or the numerical designator 128.

The rules or instructions 130 for the card 100 include at least two rules, one rule for determining play of the "CROSS THE RIVER" game and one rule for determining if the card 100 is a winning card after elements have been exposed on the card 100. The play determining rule limits a player to exposing eleven elements on the card 100 in order for the card 100 to remain valid. The win determination rule requires that the exposed elements on the card form a linked path between and including one of the start elements 106, 108, 110, 112, 114 and one of the finish elements 116, 118, 120, 122, 124 and that at least five like symbols be exposed via the elements 102 of the card 100.

The process of manufacturing and creating scratch-off type cards or tickets is known to people of ordinary skill in the art and no further discussion of such manufacturing processes is needed for purposes of elaboration and explanation of the present invention.

Figure 2:
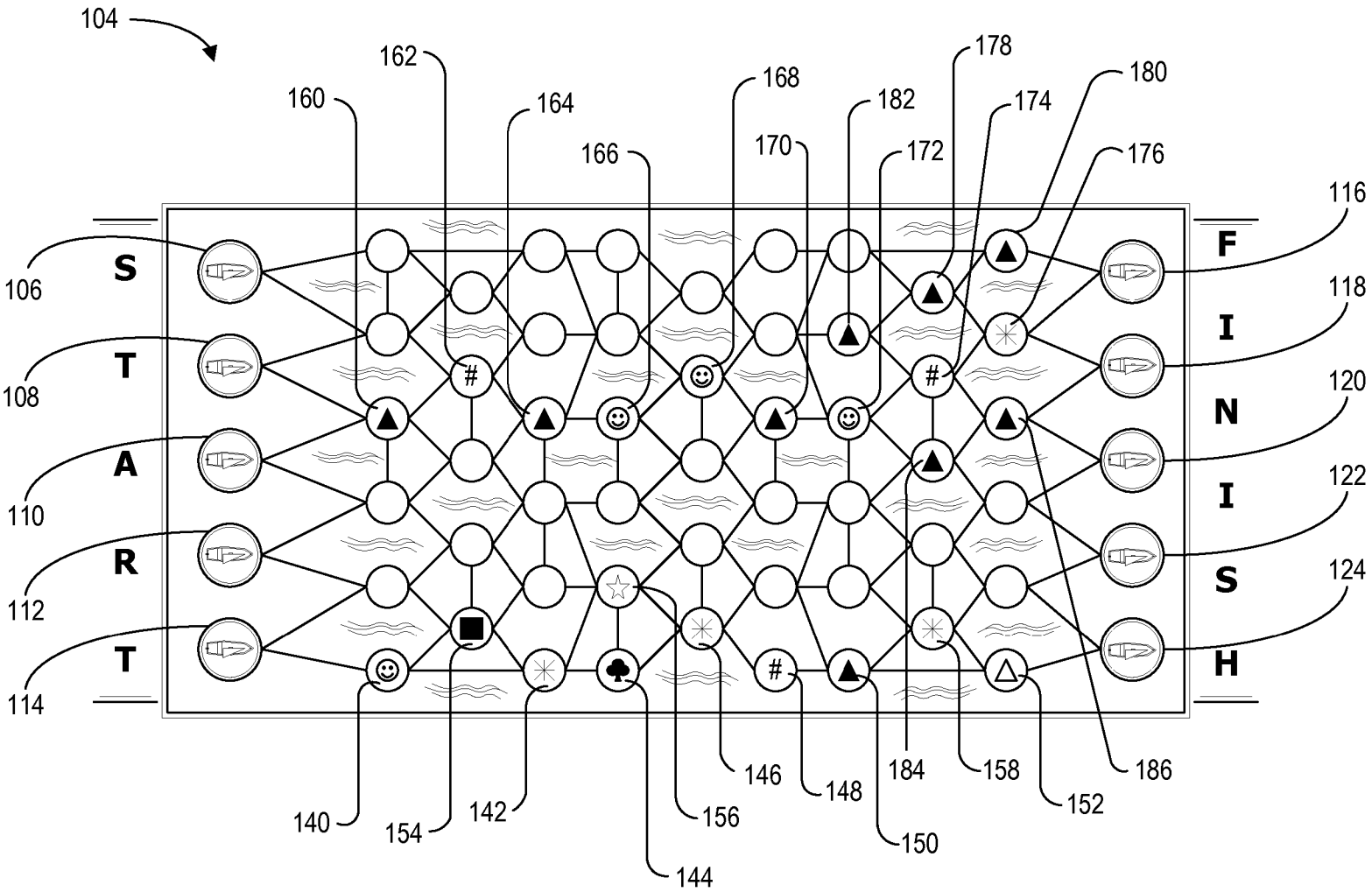
FIG. 2 is an elevation view of possible options of play for the play area for the scratch-off game card of FIG. 1.

Referring now to FIG. 2, it is apparent that many paths of exposed elements "crossing the river" are possible to connect one of the start elements 106, 108, 110, 112, 114 and one of the finish elements 116, 118, 120, 122, 124. For example, a player playing the card 100 may uncover elements and create a connected or continuous path connecting the start element 114 and the finish element 124 that includes elements 140, 142, 144, 146, 148, 150, 152. This path includes eight steps and nine elements, namely a step from the start element 114 to an element 140, a step from the element 140 to an element 142, a step from the element 142 to an element 144, a step from the element 144 to an element 146, a step from the element 146 to an element 148, a step from the element 148 to an element 150, a step from the element 150 to an element 152, and a step from the element 152 to the finish element 124.

Since, according to the rules 130 for the "CROSS THE RIVER" game, up to twelve steps may be taken to connect a start element to a finish element, a player playing the card 100 may connect the start element 114 and the finish element 124 in other ways so as to add up to four more steps. For example, a player playing the card 100 may uncover elements and create a connected path connecting the start element 114 and the finish element 124 that includes elements 140, 154, 142, 156, 144, 146, 148, 150, 158, 152. This path includes eleven steps, namely a step from the start element 114 to the element

140, a step from the element 140 to the element 154, a step from the element 154 to the element 142, a step from the element 142 to the element 156, a step from the element 156 to the element 144, a step from the element 144 to the element 146, a step from the element 146 to the element 148, a step from the element 148 to the element 150, a step from the element 150 to the element 158, a step from the element 158 to the element 152, and a step from the element 152 to the finish element 124.

As illustrated above, a player can choose which elements to expose or uncover, thereby establishing a path connecting a start element and a finish element. The player is able to ascertain all possible plays and paths for the card 100, including all paths that will connect a start element with a finish element in twelve steps or less. Of course, a player who is not paying attention or who is not careful when playing the "CROSS THE RIVER" game with the card 100 can uncover eleven or even more elements and still not have connected a start element with a finish element. If desired, more rigorous rules could be imposed that limit, broaden or otherwise change a player's options. For example, a maximum of eleven steps may be allowed as opposed to twelve steps, as delineated in the rules 130 illustrated in FIG. 1. In addition, in some embodiments, a void or "game over" indicia might be exposed when a player exposes one of the elements on the card 100, thereby ending the "CROSS THE RIVER" game.

A significant advantage of the "CROSS THE RIVER" game provided on the card 100 is that a player has input into the selections made and the card elements 102 exposed during the game and even has partial control over how the game is played. While the player must connect one of the start elements 106, 108, 110, 112, 114 with one of the finish elements 116, 118, 120, 122, 124, the player is free to decide which of the start elements 106, 108, 110, 112, 114 the player will connect, or attempt to connect, to which of the finish elements 116, 118, 120, 122, 124 as well as the path that connects them. The card 100 allows some of the start elements 106, 108, 110, 112, 114 and some of the finish elements 116, 118, 120, 122, 124 to be connected in as few as eight steps and a maximum of eleven steps are allowed in order for the card 100 to still be eligible as a winning card. In addition, all of the possible allowed paths connecting one of the start elements 106, 108, 110, 112, 114 with one of the finish elements 116, 118, 120, 122, 124 are known by or available to the player in advance. Therefore, the player is provided with considerable play and decision flexibility when playing the "CROSS THE RIVER" game via the card 100.

As illustrated by the discussion above, the card 100 also includes many player exposable or selectable elements and many sets or combinations of exposed elements are possible with the card 100 that satisfy or do not violate the rule(s) 130 associated with the card 100 for governing or determining valid play of the "CROSS THE RIVER" lottery game associated with the card 100. In addition, preferably, at least one of the sets or combinations of exposed elements for the card 100 may also render the card 100 a winning card in accordance with the rule(s) 130 established for the card 100. Furthermore, any of the elements on the card 100 can be exposed or selected first by a player without violating the rules of the "CROSS THE RIVER" game. Thus, while at least one of the start elements 106, 108, 110, 112, 114 and at least one of the finish elements 116, 118, 120, 122, 124 must be included in a connected path of elements for the path to render the card 100 a winning card according to the rules 130, a player does not have to pick or choose one of the start elements 106, 108, 110, 112, 114 or one of the finish elements 116, 118, 120, 122, 124 as the player's first play or exposed element on the card 100. For example, a player could pick the element 154 on the card 100 as the first element on the card 100 that the player exposes.

A significant advantage of the "CROSS THE RIVER" game provided on the card 100 is that a lottery organization or lottery retailer can offer an alternate and more exciting method of game play to players. As a result, lottery organizations and lottery retailers may be able to increase the appeal of scratch-off type lottery games, thereby increasing sales, revenues, profits, etc.

As provided in the rules 130 on the card 100, a player may win a prize by connecting a start element to a finish element in less than twelve elements or eleven steps such that five or more like symbols are revealed or exposed. Exposing or selecting more than twelve elements on the card 100 may void the card 100 or otherwise render a player ineligible to win a prize.

As illustrated in FIG. 2, playing or exposing the element 140 reveals a smiling face or "☺" symbol, playing or exposing the element 144 reveals a clover leaf or ""♣"" symbol, and playing or exposing the element 150 reveals a black triangle or "▲" symbol.

If desired by a lottery organization or lottery retailer, none, one, or a plurality of the valid paths connecting one of the start elements 106, 108, 110, 112, 114 and one of the finish elements 116, 118, 120, 122, 124 may include five or more like symbols. Increasing the number of the valid paths connecting one of the start elements 106, 108, 110, 112, 114 and one of the finish elements 116, 118, 120, 122, 124 that include five or more like symbols increases the chances or odds that a player will win or be entitled to a prize when playing the "CROSS THE RIVER" game with the card 100, while decreasing the number of the valid paths that include five or more like symbols connecting one of the start elements 106, 108, 110, 112, 114 and one of the finish elements 116, 118, 120, 122, 124 decreases the chances or odds that a player will win or be entitled to a prize when playing the "CROSS THE RIVER" game as embodied by the card 100.

In accordance with some embodiments, a prize may be associated with a path connecting one of the start elements 106, 108, 110, 112, 114 and one of the finish elements 116, 118, 120, 122, 124 and containing five or more like symbols. For example, the path connecting the start element 108 and the finish element 116 and including the elements 160, 162, 164, 166, 168, 170, 172, 174, 176, 178, 180 includes five black triangles or "▲" symbols. A player creating such a path on the card 100 may then be entitled to receive or redeem a prize at a lottery retailer. A prize may be monetary (e.g., ten dollars, ten-thousand dollars, etc.), non-monetary (e.g., ten-thousand frequent flyer miles, one hour of long distance calling time, four free movie tickets, two free "CROSS THE RIVER" game cards, etc.), or a combination of monetary and non-monetary amounts or awards.

In some embodiments, the amount or value of a prize may vary depending on a player's winning efficiency. For the "CROSS THE RIVER" game depicted on the card 100, winning efficiency may be defined as the number of like symbols, bar codes, etc. divided by the number of exposed elements. For example, the path connecting the start element 108 and the finish element 118 and including the elements 160, 162, 164, 166, 168, 170, 172, 174, 176, 178, 180 includes five black triangles or "▲" symbols and eleven exposed elements. Thus, the winning efficiency for this path is 45.45 percent (i.e., %45.45=%100×5/11). If a player creates a path connecting the start element 108 and the finish element 118 that includes the elements 160, 162, 164, 166, 168, 170, 172, 182, 176, 178, 180 the path would have six black triangles or "▲"

symbols and eleven exposed elements and the winning efficiency for the path is 54.55 percent (i.e., %54.55=%100×6/11). If a player creates a path connecting the start element 108 and the finish element 118 that includes the elements 160, 162, 164, 166, 168, 170, 172, 184, 186, the path would have five black triangles or "▲" symbols and nine exposed elements and the winning efficiency for this path is 55.56 percent (i.e., %55.56=%100×5/9).

When the card 100 is presented to a lottery retailer for remittance or redemption, the card 100 can be scanned by a retailer terminal to determine whether or not a path or series of exposed symbols, bar codes, etc. corresponds to at least one winning path or series either represented elsewhere on the card 100, stored locally, or stored remotely at a lottery server. Alternately, the card 100 may be scanned and interpreted via a machine-readable technique incorporating referential codes (either encrypted or non-encrypted) located throughout the card 100. Possible winning outcomes incorporating bar codes or numerical sequences may be exposed by the player and cross-referenced against the code to determine the proper payout or payoff for a winning card. As an added security feature of the present invention, the removable latex or concealer on the game card 100 itself may include one or more embedded bar codes, thereby rendering tickets difficult to forge or counterfeit. The process by which a player's game ticket or card is determined or interpreted to be a winner may also include exclusionary practices. In this manner, a retailer's lottery terminal may scan a player's card to determine if required winning elements are present or exposed on the card while one or more losing or negating elements are not present or not exposed on the card. Following the card validation process, any resultant payout may be provided to the player.

Determining whether a card is a winning card based on player exposed elements can also be based on set tolerance aspects of a game embodied on the card. For example, a player selecting a path from the start element 114 to the finish element 116 on the card 100 via the elements 140, 142, 144, 146, 148, 150, 152, 158, etc. would be able to establish a path that is within the rules of the "CROSS THE RIVER" game. Thus, once the elements 140, 152 are exposed by the player, the element 176 automatically becomes a "voiding" element as its exposure prevents the player from creating a path connecting a start element and a finish element on the card 100 using the three elements 176, 140 and 152.

Figure 3:
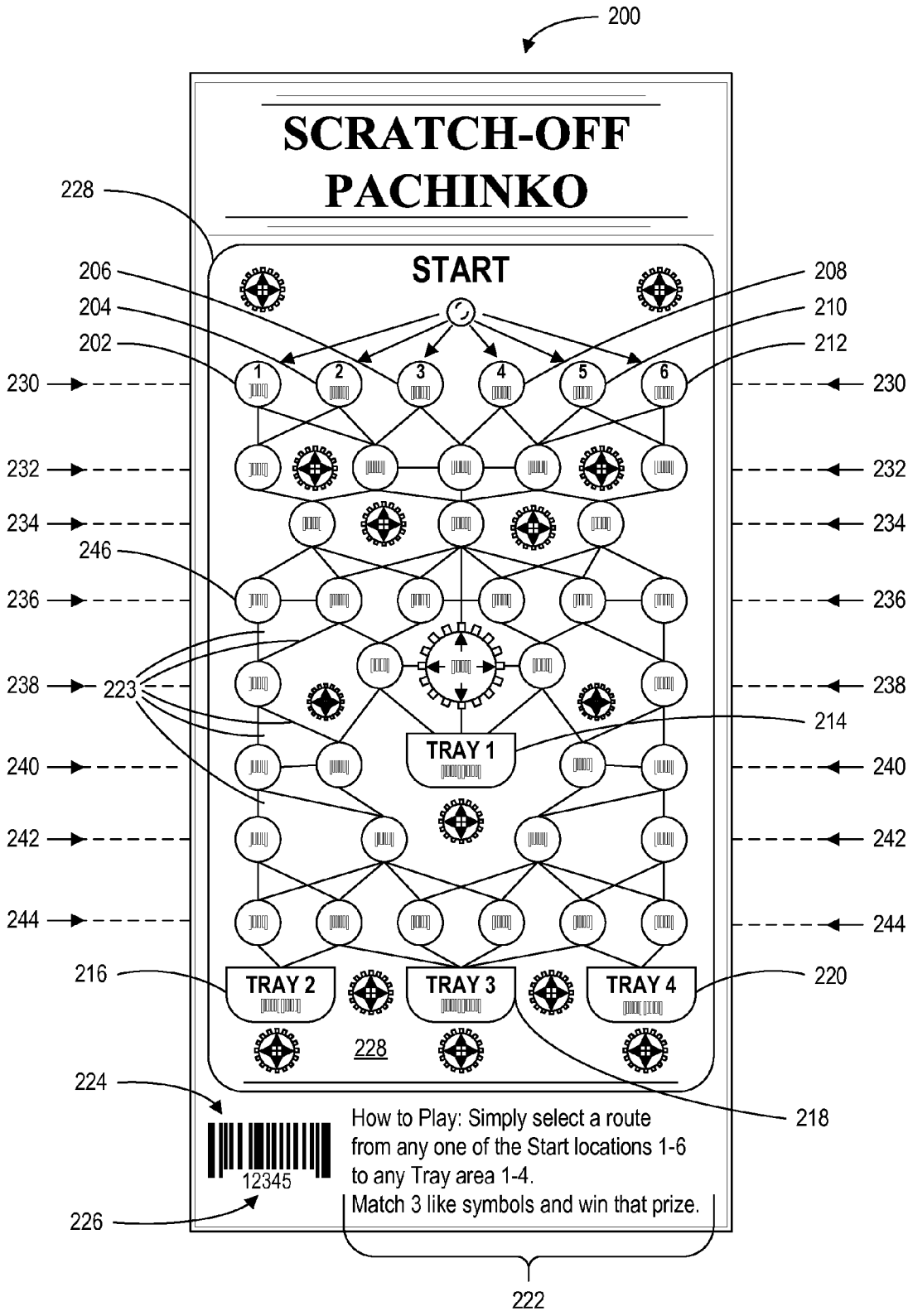
FIG. 3 is an elevation view of a second embodiment of a lottery or scratch-off game card in accordance with the present invention.

Referring now to FIG. 3, a second embodiment 200 of a card configured in accordance with the present invention is illustrated. The card 200 is configured as a scratch-off type game ticket for a lottery game entitled "SCRATCH-OFF PACHINKO" wherein a player reveals anywhere from five or eight play elements or pads, such that a continuous or linked path is created between and including one of the six starting elements 202, 204, 206, 208, 210, 212 and an element 214 entitled "TRAY 1" or such that a continuous path is created between one of the six starting elements 202, 204, 206, 208, 210, 212 and one of a three finishing elements 216, 218, 220 entitled "TRAY 2," "TRAY 3" and "TRAY 4," respectively. A path that exposes or uncovers three or more like symbols, bar codes, etc. may entitle a player to a prize, as described in a rules 222 portion of the card 200. Each of the elements on the card 200, including each of the start elements 202, 204, 206, 208, 210, 212 and each of the tray elements 214, 216, 218, 220 is linked to at least one other element on the card 200 via a link 223 as a result of the graphic design of the card 200. Like the "CROSS THE RIVER" card 100 previously described above, the card 200 may include a bar code 224 and numerical designator 226 which identify the card 200 or provide other information about the card 200 or its associated "SCRATCH-OFF PACHINKO" game.

The "SCRATCH-OFF PACHINKO" game illustrated in FIG. 3 is based on the classic game of Pachinko, which resembles a vertical version of American pinball. In general, Pachinko is a game of chance involving a cabinet housing a game board and a pinball machine-like flipper. The board within the cabinet is covered with a pattern of protruding nails. A player inserts coins into the cabinet via a coin acceptor device and in exchange, receives several small steel balls, roughly a quarter inch in diameter. These balls are then launched upward into play by actuating the flipper. If one or more of these balls come to rest on certain areas of the board, the player is rewarded with more balls to shoot. Many players employ tactics such as exercising varying degrees of force when actuating the flipper. In most Pachinko parlors, following game play, a player's winnings received may be exchanged for one or more small prizes, such as candy. Thus, a "skilled" Pachinko player may be entitled to more, or better prizes from the particular parlor. Indeed, the exciting format of Pachinko abroad, much like pinball domestically, appeals to players en masse. However, both pinball and Pachinko games lack the accessibility and the availability of traditional lottery games.

In the Pachinko simulation embodiment created by the card 200, according to the game rules 222, a player may face certain junctures at which decisions must be made by the player as to whether to proceed left or right in a downward path through a play area 228 on the card 200 from one of the starting elements 202, 204, 206, 208, 210, 212 to one of the tray elements 214, 216, 218, 220. A player's selection of a path through the card would entitle the player to win a prize if the player uncovers three or more like symbols, bar codes, etc. on the card 200. Each valid path connecting one of the starting elements 202, 204, 206, 208, 210, 212 to the "TRAY 1" element 214 includes one and only one element from each of the five element levels 230, 232, 234, 236, 238 while each valid path connecting one of the starting elements 202, 204, 206, 208, 210, 212 to one of the three tray elements 216, 218, 220 includes one and only one element from each of the eight element levels 230, 232, 234, 236, 238, 240, 242, 244.

The rules or instructions 222 on the card 200 include at least two rules, one rule for determining play of the "SCRATCH-OFF PACHINKO" game and one rule for determining if the card 200 is a winning card after elements have been exposed on the card 200. The play determining rule limits a player to exposing one element on each level 230, 232, 234, 236, 238, 240, 242, 244 on the card 200 in order for the card 200 to remain valid. The win determination rule requires that the exposed elements on the card 200 form a path between one of the start elements 202, 204, 206, 208, 210, 212 and one of the tray elements 214, 216, 218, 220 and that at least three like symbols be exposed on or by the elements of the card 200.

Like the "CROSS THE RIVER" game embodied on the card 100, a significant advantage of the "SCRATCH-OFF PACHINKO" game embodied on the card 200 is that a player has input into selections made during the game and even partial control over how the game is played. While the player must connect one of the start elements 202, 204, 206, 208, 210, 212 with one of the finish or tray elements 214, 216, 218, 220, the player is free to decide which of the start elements 202, 204, 206, 208, 210, 212 the player will connect, or attempt to connect, to which of the finish elements 214, 216, 218, 220 as well as the path that connects them. In addition, all of the possible paths connecting one of the start elements 202, 204, 206, 208, 210, 212 with one of the finish or tray elements 214, 216, 218, 220 are known or available to the player in advance. Therefore, the player is provided with considerable play and decision flexibility prior to as well as during play of the "SCRATCH-OFF PACHINKO" game via the card 200. In some embodiments, however, a void or "game over" indicia might be exposed when a player exposes one of the elements on the card 200, thereby ending the "SCRATCH-OFF PACHINKO" game.

Also like the "CROSS THE RIVER" game embodied in the card 100, in some embodiments, a prize may be associated with a path connecting one of the start elements 202, 204, 206, 208, 210, 212 and one of the finish elements 214, 216, 218, 220 and containing three or more like symbols. A player creating such a path on the card 200 may then be entitled to receive or redeem a prize at a lottery retailer. A prize may be monetary (e.g., ten dollars, ten-thousand dollars, etc.), non-monetary (e.g., ten-thousand frequent flyer miles, one hour of long distance calling time, four free movie tickets, two free "CROSS THE RIVER" or "SCRATCH-OFF PACHINKO" game cards, etc.), or a combination of monetary and non-monetary amounts or awards.

As illustrated by the discussion above, the card 200 also includes many player exposable or selectable elements and many sets or combinations of exposed elements are possible with the card 200 that satisfy or do not violate the rule(s) 222 associated with the card 200 for governing or determining valid play of the "SCRATCH-OFF PACHINKO" lottery game associated with or embodied by the card 200. In addition, preferably, at least one of the sets or combinations of exposed elements for the card 200 also renders the card 200 a winning card in accordance with the rule(s) 222 established for the card 200. Furthermore, any of the elements on the card 200 can be exposed or selected first by a player without violating the rules of the "SCRATCH-OFF PACHINKO" game. Thus, while at least one of the start elements 202, 204, 206, 208, 210, 212 and at least one of the tray elements 214, 216, 218, 220 must be included in a connected path of elements for the path to render the card 200 a winning card according to the rules 222, a player does not have to pick one of the start elements 202, 204, 206, 208, 210, 212 or one of the tray elements 214, 216, 218, 220 as the player's first play or initially exposed element. For example, a player could pick the element 246 on the card 200 as the first element on the card 200 that the player exposes.

In some embodiments, the amount or value of a prize may vary depending on a player's winning efficiency or the tray element used in the path of connected elements on the card 200. For the "SCRATCH-OFF PACHINKO" game depicted on the card 200, winning efficiency may be defined as the number of like symbols, bar codes, etc. divided by the number of exposed elements. For example, the path connecting the start element 208 and the finish element 218 includes nine elements. If the path contains four matching symbols, the winning efficiency of the path is 44.44 percent (i.e., %44.44=%100×4/9). If the path contains six matching symbols, the winning efficiency of the path is 66.67 percent (i.e., %66.67=%100×6/9). The path connecting the start element 208 and the finish element 214 includes six elements. If the path contains four matching symbols, the winning efficiency of the path is also 66.67 percent (i.e., %66.67=%100×4/6). If the path contains three matching symbols, the winning efficiency of the path is fifty percent (i.e., %50.00=%100×3/6). Like the card 100, in some embodiments the card 200 may also be redeemed or remitted at a lottery retailer for a prize associated with a winning path on the card 200.

Figure 4:
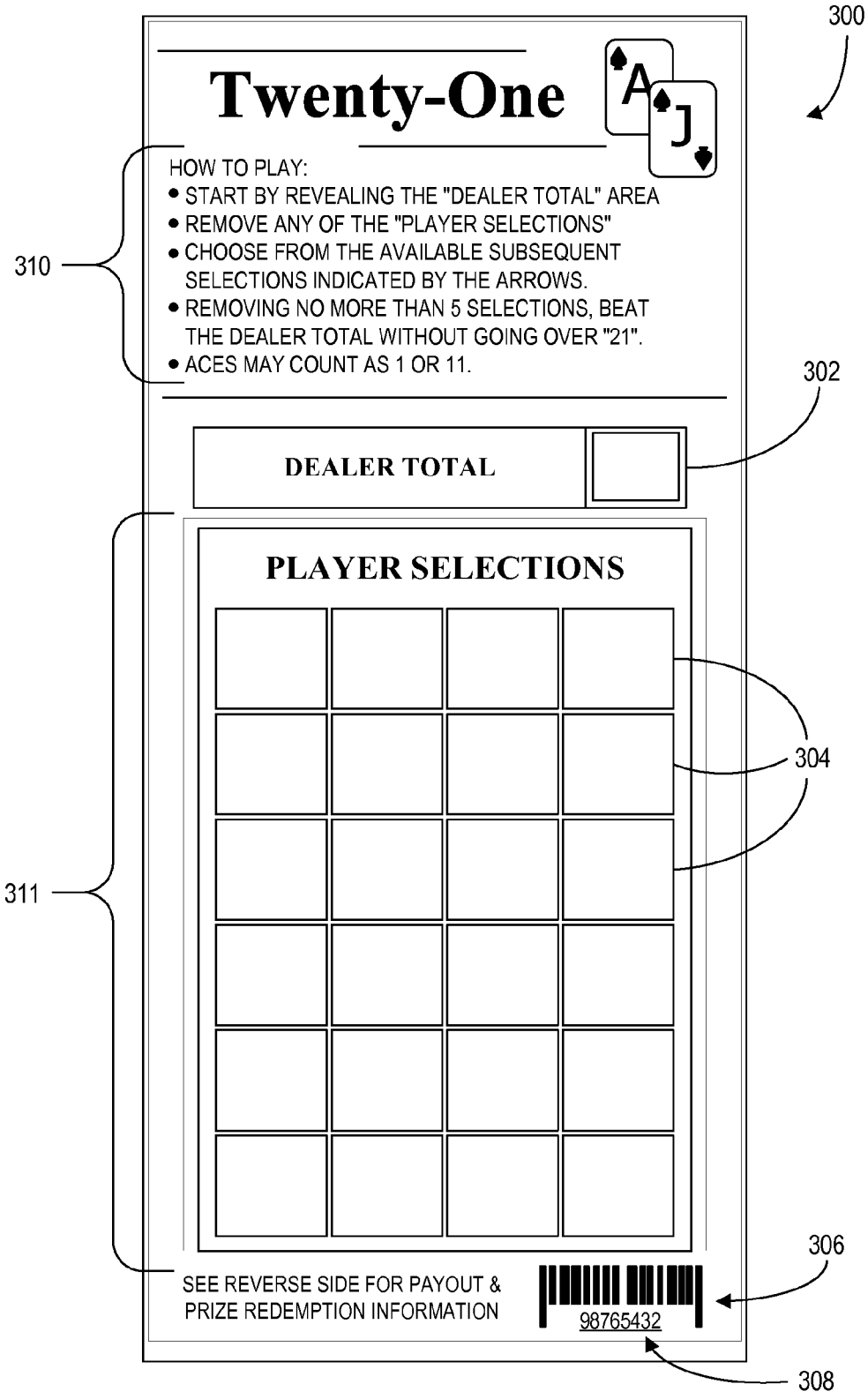
FIG. 4 is an elevation view of a third embodiment of a lottery or scratch-off game card in accordance with the present invention.

Referring now to FIG. 4, a third embodiment 300 of a card configured in accordance with the present invention is illustrated. The card 300 is configured as a scratch-off type game ticket for a lottery game entitled "TWENTY-ONE" wherein a player reveals or exposes a dealer total element 302 and then two to five connected or otherwise mutually associated elements 304 to reveal or expose two to five numbers that have a higher sum total than the dealer total but not totaling more than twenty-one. Thus, the card 300 is a form of scratch-off blackjack, a well known playing card game. In some embodiments, the dealer total may already be exposed before a player purchases the card. Like the cards 100, 200 previously discussed above, the card 300 includes a bar code 306, a numerical designator 308, and a rules area 310 for the "TWENTY-ONE" game. However, unlike the "CROSS THE RIVER" and "SCRATCH-OFF PACHINKO" games embodied by the cards 100, 200, respectively, the "TWENTY-ONE" game embodied by the card 300 includes the element 302 which is outside the play area 311 of the card 300.

Also in contrast to the "CROSS THE RIVER" and "SCRATCH-OFF PACHINKO" games embodied by the cards 100, 200, respectively, the "TWENTY-ONE" game embodied by the card 300 does not provide a player with advance knowledge of all possible plays on the card 300. However, the player may choose any of the elements 304 on the card 300 as the first element, thereby providing the player with considerable flexibility in playing the "TWENTY-ONE" game with or via the card 300. After a player makes a first play and exposes one of the elements 304, the exposed element will provide the player with further options as to how play of the card 300 is allowed to progress, as provided by the rules 310 and as will be discussed in more detail below. In addition, in some embodiments, a void or "game over" indicia might be exposed when a player exposes one of the elements on the card 300, thereby ending the "TWENTY-ONE" game.

Figure 5:
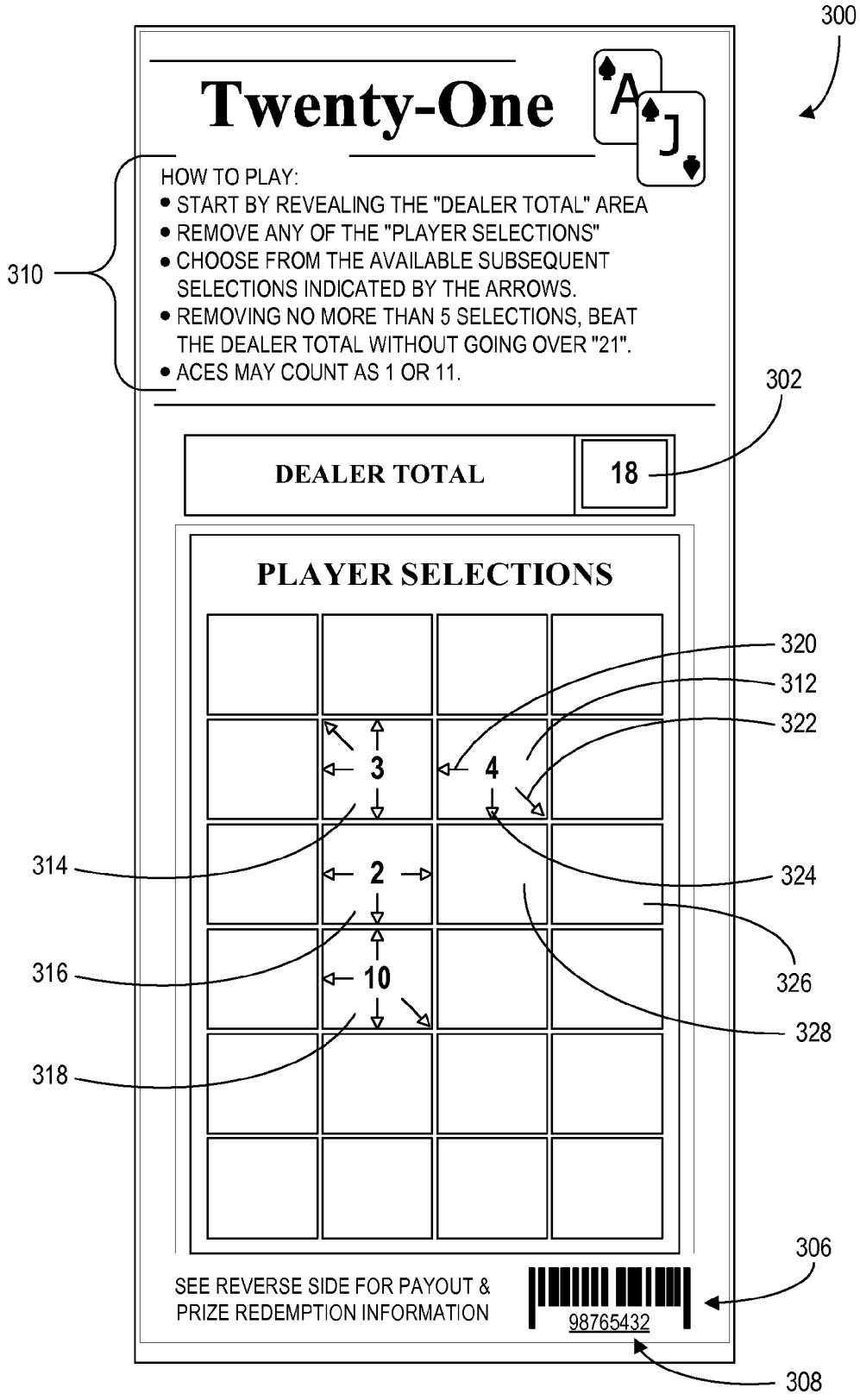
FIG. 5 is an elevation view of possible options of play for the scratch-off game card of FIG. 4.

Referring now to FIG. 5, a representative game of "TWENTY-ONE" in progress using the card 300 is illustrated. For this game, the dealer total is "18," as shown in the exposed element 302. In addition, a player has uncovered four elements 312, 314, 316, 318 in accordance with the rules 310. In this example, the player uncovered the element 312 first, and then the elements 314, 316, 318 in that order. Each of the elements 312, 314, 316, 318 include a number and two or more arrows indicating which adjacent elements may be exposed next. For example, the element 312, when exposed, includes the number "4" and three arrows 320, 322, 324. The arrow 320 points to the element 314, the arrow 322 points to the element 326, and the arrow 324 points to the element 328. Therefore, once the player has played or revealed the element 314, the options for the player include exposing the element 320, exposing the element 322, exposing the element 324, or stopping. Since the players total of "4" does not exceed the dealer total of "18," the player presumably would proceed to expose one or more additional elements 314, 326, 328. Since the element 312 does not include arrows pointing to elements other than the elements 314, 326, 328, none of the other elements on the card 300 are available for the player to expose at this point. Thus, the player must expose only one of the elements 314, 326, 328 on the player's next move.

In this example, the player has chosen to expose the element 314, thereby revealing the number "3" and four additional arrows, one of which points to the element 316 and three of which point to other elements on the card 300. After exposing the elements 312, 314, the player's sum total is equal to "7" (i.e., "4" from the element 312 plus "3" from the element 314). Since the player has not yet beaten or exceeded the dealer total of "18," the player has decided to continue playing and exposes the element 316, thereby revealing the number "2" and three more arrows, one of which points to the element 318 and two of which point to other elements on the card 300. After exposing the elements 312, 314, 316, the player's sum total is equal to "9" (i.e., "4" from the element 312 plus "3" from the element 314 plus "2" from the element 316). Since the player still has not yet beaten or exceeded the dealer total of "18," the player has decided to continue playing and exposes the element 318, thereby revealing the number "10" and four more arrows. After exposing the four elements 312, 314, 316, 318, the player has a sum total equal to "19" (i.e., "4" from the element 312 plus "3" from the element 314 plus "2" from the element 316 plus "10" from the element 318). Thus, the player has beaten or exceeded the dealer total of "18" while following the rules 310. As a result, the player has won the "TWENTY-ONE" game on the card 300. Even though the player may select or uncover one of three new elements based on the arrows associated with the element 318, the player decides to stop playing.

As shown by this example, arrows located on exposed elements dictate the options for a player's future play. For example, had the player first exposed the element 314 instead of the element 312, the player could not have exposed the element 312 on the player's next play as no arrow in the exposed element 314 points to the element 312. Similarly, while the player was able to expose the element 316 directly after exposing the element 314 because an arrow in the exposed element 314 pointed to the element 316, the player would not have been able to expose the element 314 directly after exposing the element 316 since no arrow in the exposed element 316 points to the element 314. Each element on the card 300 preferably is linked to at least two other elements on the card 300 via one or more arrows so that a player of the card 300 is provided with options at each stage of play of the "TWENTY-ONE" game on the card 300.

As illustrated by the discussion above, the card 300 also includes many player exposable or selectable elements and many sets or combinations of exposed elements are possible with the card 300 that satisfy or do not violate the rule(s) 310 associated with the card 300 for governing or determining valid play of the "TWENTY-ONE" lottery game associated with or embodied by the card 300. In addition, preferably, at least one of the sets or combinations of exposed elements for the card 300 also renders the card 300 a winning card in accordance with the rule(s) 310 established for the card 300. Furthermore, any of the elements on the card 300 can be exposed or selected first by a player without violating the rules of the "TWENTY-ONE" game.

Like the cards 100 and 200 previously described above, a monetary and/or non-monetary prize may be associated with a card 300 and the value of the prize may be based on the card's winning efficiency. According to the rules 310 for the card 300, the card will not be considered a winning card if a player exposes more than five elements, the total of the numbers for the exposed elements on the card 300 exceeds twenty-one, or the total of the numbers for the exposed elements on the card 300 are less than or equal to the dealer total shown in the element 302.

Winning efficiency for the "TWENTY-ONE" game embodied by the card 300 can be defined in a number of ways. For example, winning efficiency for the "TWENTY-ONE" game embodied by the card 300 may be defined as five minus the number of exposed elements (other than the dealer total element 302) on the card divided by five. For example, for the card 300 illustrated in FIG. 5, the winning efficiency is twenty percent (i.e., %100×(5−4)/5). Such an algorithm for winning efficiency may reward a player more for beating the dealer total in a fewer number of exposed elements.

An alternative winning efficiency for the "TWENTY-ONE" game embodied by the card 300 may be defined as the number of exposed elements divided by five. With this algorithm, the card 300 illustrated in FIG. 5 has a winning efficiency of eighty percent (i.e., %80=%100×(4/5)). The second algorithm may reward a player more for beating the dealer total in a higher number of elements and recognizes the fact that each exposed element increases the player's total, thereby making it more difficult for a player not to exceed twenty-one if the player reveals or exposes another element on the card 300.

The rules or instructions 310 on the card 300 include at least two rules, one rule for determining play of the "TWENTY-ONE" game and one rule for determining if the card 300 is a winning card after elements have been exposed on the card 300. The exemplary play determining rule illustrated in FIG. 5 limits a player to exposing no more than five connected elements on the card 300 in order for the card 300 to remain valid. The exemplary win determination rule illustrated in FIG. 5 requires that the numbers corresponding to exposed elements on the card 300 total more than the dealer total exposed at the element 302 on the card 300.

In addition to the above, each of the cards 100, 200, 300 described above may be created by and used with a single computer, computer system, a lottery server, a lottery retailer, etc. in an electronic format. Furthermore, each of the cards 100, 200, 300 may be created and displayed by a screen, monitor, etc. on a computer, personal digital assistant, workstation, kiosk, etc. so that the cards can be played online, virtually or electronically. In such embodiments, elements on the cards may be exposed on the screen, monitor, display, etc. for a player when a player inputs, makes or indicates an element selection on a card. Signals representative or indicative of a card may be transmitted or otherwise provided from a server, computer system, World Wide Web site, etc. to a player's computer, personal digital assistant, etc. In addition, the server, computer system, World Wide Web site, etc. may receive signals from a player's computer, personal digital assistant, etc. representative or indicative of the player' selections of elements to expose on a card. Signals may continue to be transmitted and received until a game outcome is reached for the card, which may or may not be a winning outcome for the card. After a game outcome is determined for the card, the game outcome and, if desired, whether or not the game outcome is a winning game outcome, may be indicated to a player by sending another signal indicative of the game outcome to the player.

Figure 6:
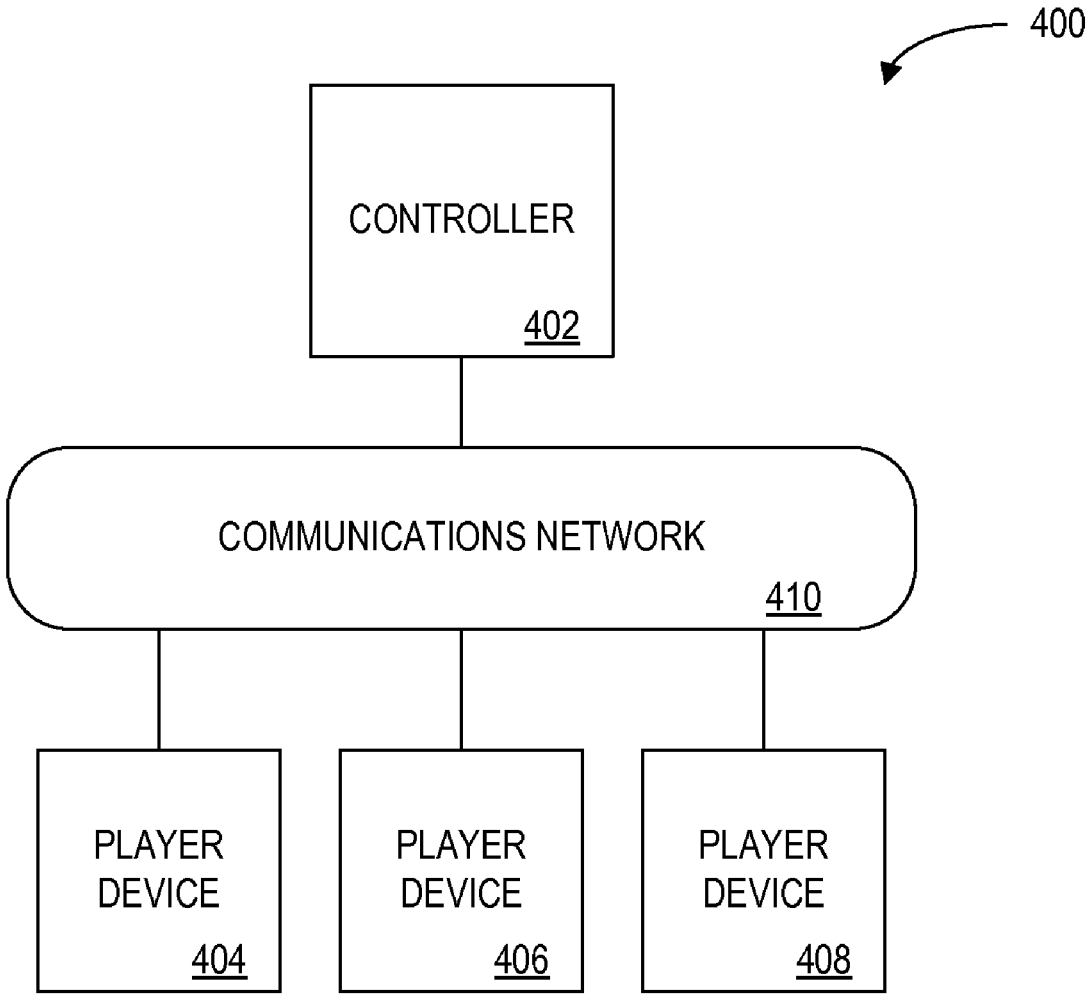
FIG. 6 is a block diagram of a system with which electronic versions of the cards of FIGS. 1, 3 and 4 can be used.

Referring now to FIG. 6, an apparatus or system 400 usable in accordance with electronic versions of the cards 100, 200, 300 is illustrated. The apparatus 400 includes a controller 402 that may communicate with one or more player devices or lottery terminals 404, 406, 408 via a computer, data, or communications network 410. The controller 402 may be associated with a lottery organization, lottery retailer, etc. and may transmit electronic versions of the cards 100, 200, 300 or signals otherwise indicative of the cards 100, 200, 300. Player devices, such as lottery terminals, may be mobile and carried by players, or stationary. Player devices may be located in retailers and owned or operated by retailers, lottery organizations, government organizations, etc. The configuration, operation and use of the controller 402 will be described in more detail below.

The player devices 404, 406, 408 preferably allow players to interact with the controller 402 and the remainder of the apparatus 400. The player devices 404, 406, 408 may also enable a player to receive from the controller 402 electronic versions of the cards 100, 200, 300 or signals otherwise indicative of the cards 100, 200, 300. If desired, the player devices 404, 406, 408 may also be connected to or otherwise in communication with other devices. The configuration, operation and use of player devices will be described in more detail below.

The communications network 410 might be the Internet, the World Wide Web, or some other public or private computer or communications network or intranet, as will be described in further detail below. The communications network 410 is meant to be generally representative of cable, computer or other communication networks for purposes of elaboration and explanation of the present invention. Other devices, networks, etc. may be connected to the communications network 410 without departing from the scope of the present invention. The communications network 410 is also intended to be representative of, and include all or a part of, the Internet, the World Wide Web, and other privately or publicly operated networks. The communications network 410 can also include other public and/or private wide area networks, local area networks, extranets, data communication networks or connections, intranets, routers, satellite links, microwave links, cellular or radio links, fiber optic transmission lines, ISDN lines, T1 lines, DSL, etc.

Figure 7:
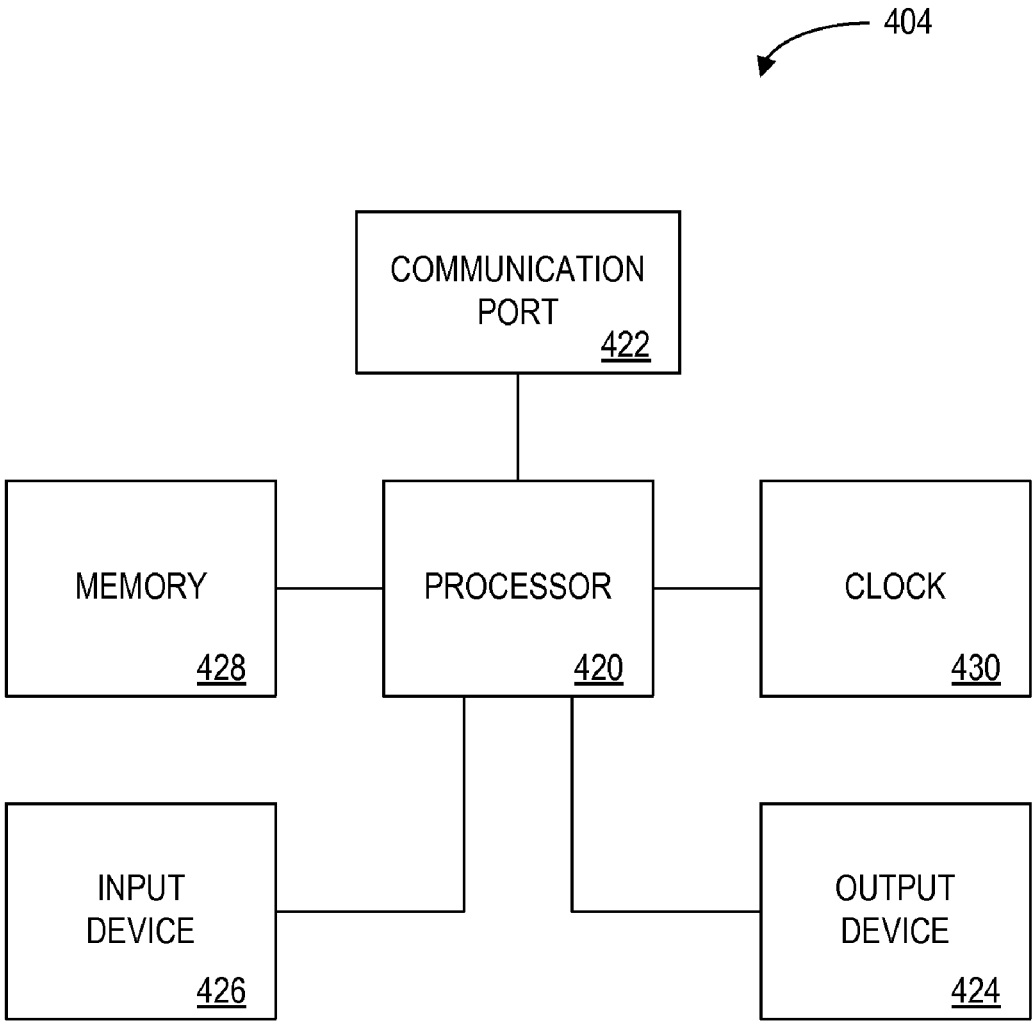
FIG. 7 is a block diagram of a possible player device of the system of FIG. 6.

Referring now to FIG. 7, a representative block diagram of a player device, such as the player device 404, is illustrated. The player device 404 may include a processor, central processing unit, microchip, or computer 420 that is in communication with or otherwise uses or includes one or more communication ports 422 for communicating with the controller 402 and/or with other devices. For example, the player device 404 may have an infrared or other transmitter as one communication port to allow the player device 404 to communicate with the controller 402. In addition, if the player device 402 is connected to the controller 402 via an Ethernet local area network, the player device 404 will preferably include an Ethernet adapter as a communication port to allow the player device 404 to communicate with the controller 402.

The player device 404 may include one or more output devices 424 to allow the player device 404 to provide or display information, messages, electronic versions of cards, electronic signals indicative of cards, etc., to the controller 402 or to a player, such as a printer, lottery ticket or card dispenser, audio speaker, infrared or other transmitter, antenna, display screen or monitor, text to speech converter, etc., as well as one or more input devices 426 for receiving information, messages, indications, card element selections, etc. from a player, such as a bar code reader or other optical scanner, infrared or other receiver, antenna, magnetic stripe reader, image scanner, roller ball, touch pad, joystick, touch screen, microphone, computer keyboard, computer mouse, etc. A player device 404 may include a voice recognition system or interactive voice response unit as an input device 426 to aid in receiving and processing player element selections. The player device 404 may also include a fingerprint scanner or reader, a retinal scanner, a voice analyzer, or other biometric data input device as an input device 426 to allow the player device 404 to identify players.

In addition to the above, the player device 404 may include a memory or data storage device 428 to store information, electronic versions of game cards, electronic signals indicative of game cards, software, databases, device drivers, player information, player identifications, etc. The memory or data storage device 428 preferably comprises an appropriate combination of magnetic, optical and/or semiconductor memory, and may include, for example, Random Access Memory (RAM), Read-Only Memory (ROM), a tape drive, flash memory, a floppy disk drive, a ZIP™ disk drive, a compact disc and/or a hard disk.

The player device 404 may also include an internal clock element 430 for maintaining an accurate time and date for the player device 404 and for creating time stamps for information, electronic versions of cards, electronic signals indicative of cards, player element selections, etc. generated or received via the player device 404.

As previously discussed above, possible player devices include a personal computer, portable computer, mobile or fixed user station, workstation, network terminal or server, telephone, beeper, kiosk, dumb terminal, personal digital assistant, facsimile machine, etc. If desired, the player device 404 may also function as the controller 402.

Figure 8:
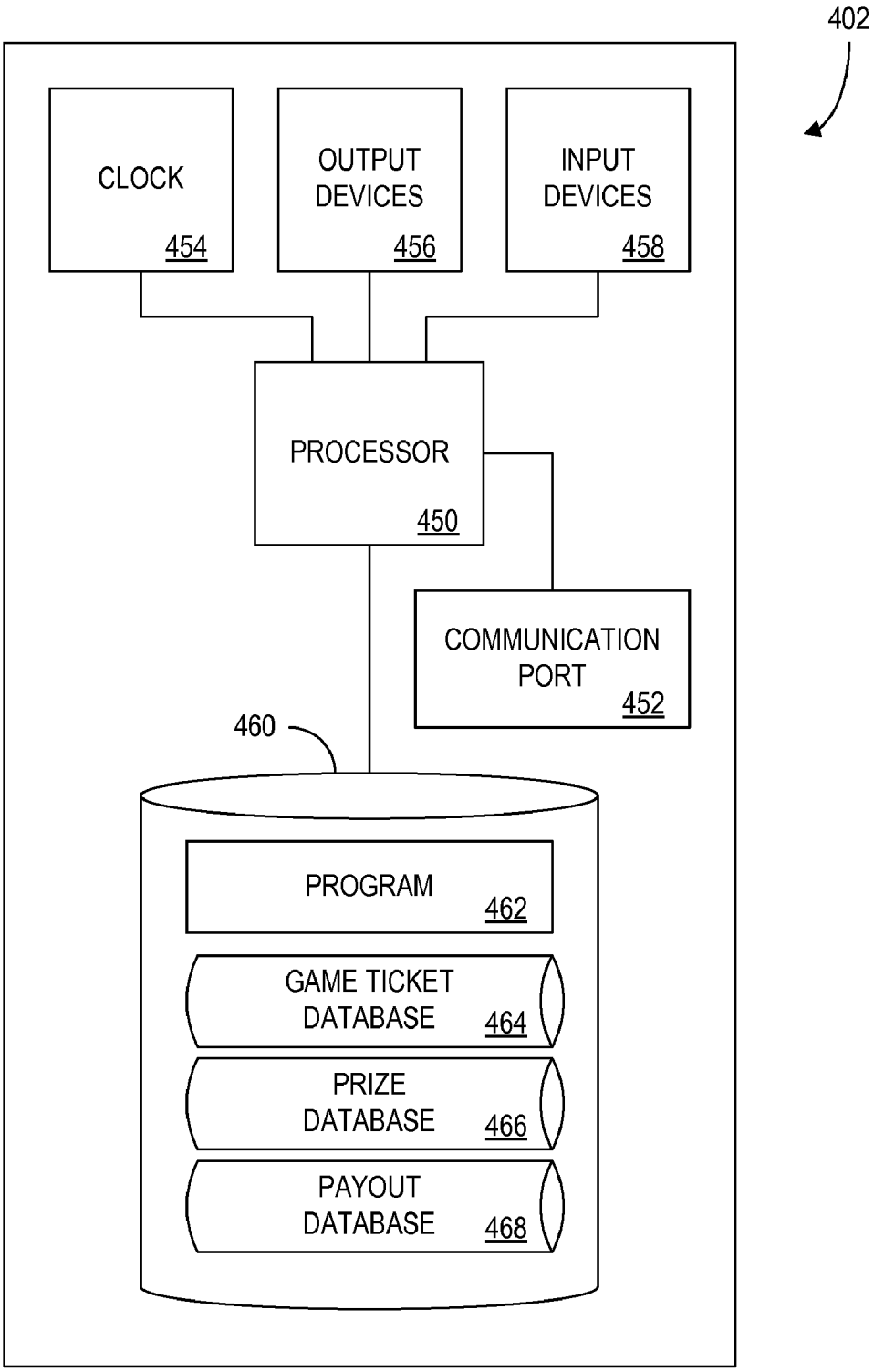
FIG. 8 is a block diagram of a possible controller of the system of FIG. 6.

Referring now to FIG. 8, a representative block diagram of a controller, such as the controller 402, is illustrated. The controller 402 may include a processor, microchip, central processing unit, or computer 450 that is in communication with or otherwise uses or includes one or more communication ports 452 for communicating with player devices, lottery terminals and/or other devices. For example, if the controller 402 is connected to the player device 404 via an Ethernet local area network, the player device 406 via a cellular telephone network, and the player device 408 via a Token Ring type local area network, the controller 402 may have an Ethernet adapter as one communication port to allow the controller 402 to communicate with the player device 404, a connection to a cellular telephone network as another communication port to allow the controller 402 to communicate with the player device 406 and a Token Ring adapter to allow the controller 402 to communicate with the player device 408.

The controller 402 may also include an internal clock element 454 for maintaining an accurate time and date for the controller 402, create time stamps for signals generated via the controller 402 or received by the controller 402, etc.

If desired, the controller 402 may include one or more output devices 456 such as a printer, lottery ticket or card dispenser, infrared or other transmitter, antenna, audio speaker, display screen or monitor, text to speech converter, etc., as well as one or more input devices 458 such as a bar code reader or other optical scanner, infrared or other receiver, antenna, magnetic stripe reader, image scanner, roller ball, touch pad, joystick, touch screen, microphone, computer keyboard, computer mouse, etc. In addition, the controller 402 may include a voice recognition system or interactive voice response unit as an input device 458 to aid in or enable receiving and processing of information from a player or player device. The controller 402 may also include a fingerprint scanner or reader, a retinal scanner, a voice analyzer, or other biometrics data input device as an input device 458 to allow the controller 402 to identify the player. If desired, the controller 402 may also function as a player device.

In addition to the above, the controller 402 may include a memory or data storage device 460 to store information, software, databases, device drivers, win efficiency formulas, prize information, player information, etc. The memory or data storage device 460 preferably comprises an appropriate combination of magnetic, optical and/or semiconductor memory, and may include, for example, Random Access Memory (RAM), Read-Only Memory (ROM), a tape drive, flash memory, a floppy disk drive, a ZIP™ disk drive, a compact disc and/or a hard disk. The processor 450 and the data storage device 460 in the controller 402 may each be, for example: (i) located entirely within a single computer or other computing device; or (ii) connected to each other by a remote communication medium, such as a serial port cable, telephone line or radio frequency transceiver. In one embodiment, the controller 402 may comprise one or more computers that are connected to a remote server computer for maintaining databases.

A conventional personal computer or workstation with sufficient memory and processing capability may be used as the controller 402. In one embodiment, the controller 402 operates as or includes a World Wide Web server for an Internet environment. The controller 402 preferably transmits and receives data related to lottery games, cards, etc. and is capable of high volume transaction processing, performing a significant number of mathematical calculations in processing communications and database searches. A Pentium™ microprocessor such as the Pentium III™ microprocessor, manufactured by Intel Corporation may be used for the processor 450. Equivalent processors are available from Motorola, Inc., AMD, and Sun Microsystems, Inc. The processor 450 may also comprise one or more microprocessors, computers, computer systems, etc.

While specific implementations and hardware configurations for the controller 402 have been illustrated, it should be noted that other implementations and hardware configurations are possible and that no specific implementation or hardware configuration is needed for the controller 402.

Software may be resident and operating or operational on the controller 402. The software may be stored on the data storage device 460 and may include some or all of the following: a control program 462 for operating the controller 402, a game ticket database 464 for storing information about game cards and game tickets, and a prize database 466 for storing information about prizes or other awards associated with lottery games, lottery cards, etc. and a player database for storing information about one or more players of lottery games.

The control program 462 may control the processor 450. The processor 450 preferably performs instructions of the control program 462, and thereby operates in accordance with the present invention, and particularly in accordance with the methods described in detail herein. The control program 462 may be stored in a compressed, uncompiled and/or encrypted format. The control program 462 furthermore includes program elements that may be necessary, such as an operating system, a database management system and device drivers for allowing the processor 450 to interface with peripheral devices, databases, etc. Appropriate program elements are known to those skilled in the art, and need not be described in detail herein. According to an embodiment of the present invention, the instructions of the control program 462 may be read into a main memory from another computer-readable medium, such as from a ROM to RAM. Execution of sequences of the instructions in the control program 462 causes the processor 450 to perform the process steps described herein. In alternative embodiments, hard-wired circuitry may be used in place of, or in combination with, software instructions for implementation of some or all of the methods of the present invention. Thus, embodiments of the present invention are not limited to any specific combination of hardware and software.

When the controller 402 and a player device are used in an online embodiment, the controller 402 may provide or transmit an electronic signal indicative of a lottery game card to a player via the player device. The electronic version of the card may be displayed by or at the player device or printed out or dispensed by the player device. Once a player makes a selection of one or more elements on the card to expose or reveal, the player preferably uses the player device to indicate such selection(s) to the controller 402 and the controller 402 preferably receives a signal indicative or representative of the player selection(s) from the player device. Signals may be transmitted and received by the controller 402 and the player device until a lottery game is completed, a final game outcome is reached for the lottery game embodied by the card, the player, player device, or the controller 402 suspends or halts plays or signal transmissions, etc.

The foregoing description is considered as illustrative only of the principles of the invention. Furthermore, since numerous modifications and changes will readily occur to those skilled in the art, it is not desired to limit the invention to the exact construction and process shown and described above. Accordingly, all suitable modifications and equivalents may be resorted to falling within the scope of the invention as defined by the claims which follow. Further, even though only certain embodiments have been described in detail, those having ordinary skill in the art will certainly understand that many modifications are possible without departing from the teachings herein. All such modifications are intended to be encompassed within the following claims.

While specific implementations, configurations, and cards for the "CROSS THE RIVER," "SCRATCH-OFF PACHINKO" and "TWENTY-ONE" games have been illustrated, it should be noted that other implementations and hardware configurations are possible and that no specific implementation, configuration or card is needed. Therefore, many different types of implementations, configurations or cards can be used for the "CROSS THE RIVER," "SCRATCH-OFF PACHINKO" and "TWENTY-ONE" games and the games disclosed herein are not limited to any specific implementation, configuration or card. Likewise, the principles embodied by the cards 100, 200, 300 may be used with other games and the principles embodied by the cards 100, 200, 300 are not limited to the "CROSS THE RIVER," "SCRATCH-OFF PACHINKO" and "TWENTY-ONE" games. In fact, it is specifically envisioned that the principles of scratch-off cards described herein are capable of being used with other types of lottery games that simulate other formats including, but not limited to, chess, checkers, billiards or pool, hockey, baseball, basketball, roulette, football, and/or shuffleboard.

The present invention may be embodied as a computer program developed using an object oriented language that allows the modeling of complex systems with modular objects to create abstractions that are representative of real world, physical objects and their interrelationships. However, it would be understood by one of ordinary skill in the art that the invention as described herein can be implemented in many different ways using a wide range of programming techniques as well as general purpose hardware systems or dedicated controllers.

Each of the cards 100, 200, 300 includes multiple player exposable or selectable elements. In addition, each of the cards 100, 200, 300 includes indicia or an associated rule for determining, governing or indicating how the game associated with the card can be played or how elements on the card can be exposed or selected. Furthermore, each of the cards 100, 200, 300 includes indicia or an associated rule for determining, governing or indicating if or how the card can be considered to be a winning card.

Each of the cards 100, 200, 300 also includes many player exposable or selectable elements, and many sets or combinations of exposed elements are possible with each card that may satisfy or may not violate the rules associated with the card for governing or determining valid play of the lottery game associated with the card. In addition, preferably, at least one of the sets or combinations of exposed elements for each of the cards 100, 200, 300 also renders the card a winning card in accordance with the rule(s) established for the card.

The words "comprise," "comprises," "comprising," "include," "including," and "includes" when used in this specification and in the following claims are intended to specify the presence of stated features, elements, integers, components, or steps, but they do not preclude the presence or addition of one or more other features, elements, integers, components, steps, or groups thereof.

What is claimed is:

1. An apparatus for conducting a lottery game comprising:

a processor; and a storage device in communication with the processor, the storage device storing instructions configured to direct the processor to:

display a plurality of exposable elements in a game area of a lottery game, each exposable element in the plurality of exposable elements being adjacent to at least two other elements in the plurality of exposable elements, further in which any exposable element in the plurality of exposable elements in the game area can be exposed as an initial element, receive, by an electronic game controller, a signal indicative of a selection of an exposable element in the plurality of exposable elements as the initial element;

for any selected initial element in the plurality of exposable elements, expose the selected initial element to reveal an indication of at least two exposable elements that are adjacent to the selected initial element and that are eligible to be selected next;

receive, by the electronic game controller, a signal indicative of a selection of one of the at least two exposable elements adjacent to the selected initial element as the second element;

for any selected second element in the plurality of exposable elements, expose the selected second element to reveal an indication of at least two exposable elements that are adjacent to the selected second element and that are eligible to be selected next; and determine, by the electronic controller, a game outcome of the lottery game based on the selected initial element and the selected second element, in which determining the game outcome of the lottery game based on the selected initial element and the selected second element comprises:

determining a dealer total;

determining a player total based on a first number associated with the selected initial element and a second number associated with the selected second element; and determining the game outcome based on the dealer total, the player total and at least one game rule.

2. The apparatus of claim 1, in which the indication of the at least two exposable elements adjacent to the selected initial element comprises at least two arrows.

3. The apparatus of claim 1, in which exposing the selected initial element comprises revealing a number.

4. The apparatus of claim 1, in which the lottery game comprises an electronic blackjack lottery game card.

5. A computer readable medium storing instructions configured to direct a computing device to perform a method, the method comprising:

displaying a plurality of exposable elements in a game area of a lottery game, each exposable element in the plurality of exposable elements being adjacent to at least two other elements in the plurality of exposable elements, further in which any exposable element in the plurality of exposable elements in the game area can be exposed as an initial element, receiving, by an electronic game controller, a signal indicative of a selection of an exposable element in the plurality of exposable elements as the initial element;

for any selected initial element in the plurality of exposable elements, exposing the selected initial element to reveal an indication of at least two exposable elements that are adjacent to the selected initial element and that are eligible to be selected next;

receiving, by the electronic game controller, a signal indicative of a selection of one of the at least two exposable elements adjacent to the selected initial element as the second element;

for any selected second element in the plurality of exposable elements, exposing the selected second element to reveal an indication of at least two exposable elements that are adjacent to the selected second element and that are eligible to be selected next; and determining, by the electronic controller, a game outcome of the lottery game based on the selected initial element and the selected second element, in which determining the game outcome of the lottery game based on the selected initial element and the selected second element comprises:

determining a dealer total;

determining a player total based on a first number associated with the selected initial element and a second number associated with the selected second element; and determining the game outcome based on the dealer total, the player total and at least one game rule.

6. The computer readable medium of claim 5, in which the indication of the at least two exposable elements adjacent to the selected initial element comprises at least two arrows.

7. The computer readable medium of claim 5, in which exposing the selected initial element comprises revealing a number.

8. The computer readable medium of claim 5, in which the lottery game comprises an electronic blackjack lottery game card.

9. A method for conducting a lottery game, the method comprising:

displaying a plurality of exposable elements in a game area of a lottery game, each exposable element in the plurality of exposable elements being adjacent to at least two other elements in the plurality of exposable elements, further in which any exposable element in the plurality of exposable elements in the game area can be exposed as an initial element, receiving, by an electronic game controller, a signal indicative of a selection of an exposable element in the plurality of exposable elements as the initial element;

for any selected initial element in the plurality of exposable elements, exposing the selected initial element to reveal an indication of at least two exposable elements that are adjacent to the selected initial element and that are eligible to be selected next;

receiving, by the electronic game controller, a signal indicative of a selection of one of the at least two exposable elements adjacent to the selected initial element as the second element;

for any selected second element in the plurality of exposable elements, exposing the selected second element to reveal an indication of at least two exposable elements that are adjacent to the selected second element and that are eligible to be selected next; and determining, by the electronic controller, a game outcome of the lottery game based on the selected initial element and the selected second element, in which determining the game outcome of the lottery game based on the selected initial element and the selected second element comprises:

determining a dealer total;

determining a player total based on a first number associated with the selected initial element and a second number associated with the selected second element; and determining the game outcome based on the dealer total, the player total and at least one game rule.

10. The method of claim 9, in which the indication of the at least two exposable elements adjacent to the selected initial element comprises at least two arrows.

11. The method of claim 9, in which exposing the selected initial element comprises revealing a number.

12. The method of claim 9, in which the lottery game comprises an electronic blackjack lottery game card.

* * * * *